United States Patent [19]

Etzel

[11] Patent Number: 4,589,967

[45] Date of Patent: May 20, 1986

[54] LINING FOR AN ELECTROLYSIS CELL FOR THE PRODUCTION OF ALUMINUM

[75] Inventor: Karl W. F. Etzel, Bad Soden, Fed. Rep. of Germany

[73] Assignee: Sigri GmbH, Meitingen, Fed. Rep. of Germany

[21] Appl. No.: 628,807

[22] Filed: Jul. 9, 1984

[30] Foreign Application Priority Data

Jul. 28, 1983 [DE] Fed. Rep. of Germany ..... 3327230

[51] Int. Cl.[4] ..... C25C 3/08; C25B 11/12

[52] U.S. Cl. ..... 204/243 R; 204/294

[58] Field of Search ..... 204/243 R, 244–247, 204/294, 67; 264/29.5, 30

[56] References Cited

U.S. PATENT DOCUMENTS

| | | | |
|---|---|---|---|
| 3,616,045 | 10/1971 | Kozar et al. | 264/29.5 |
| 3,764,509 | 10/1973 | Etzel et al. | 204/243 R |
| 4,046,650 | 9/1977 | Hirasawa et al. | 204/67 |
| 4,288,353 | 9/1981 | Eckel et al. | 260/28 R |
| 4,411,758 | 10/1983 | Hess et al. | 204/243 R |
| 4,430,187 | 2/1984 | Snaelund et al. | 204/294 X |

FOREIGN PATENT DOCUMENTS

| | | | |
|---|---|---|---|
| 1362933 | 8/1974 | United Kingdom . | |
| 2103657 | 2/1983 | United Kingdom | 204/243 R |

*Primary Examiner*—Donald R. Valentine

*Attorney, Agent, or Firm*—Herbert L. Lerner; Laurence A. Greenberg

[57] ABSTRACT

Cell for the fusion-electrolytic production of aluminum which consists of a steel shell lined with graphite blocks, a heat-retarding insulation layer between the shell and the lining and cathodic bus bars inserted into the lining. Features of the invention are (a) the lining consists of graphite blocks with a heat conductivity of 80 to 120 W/m·K, an electric resistivity from 6 to 13 μΩm and an accessible pore volume of at most 22%, (b) the insulating layer contains at least two partial layers with a heat conductivity of 0.1 to 0.2 and 0.8 to 1.2 W/m·K, (c) the thickness ratio of the lining and the insulating layer is 1.5 to 3.0.

11 Claims, 2 Drawing Figures

LINING FOR AN ELECTROLYSIS CELL FOR THE PRODUCTION OF ALUMINUM

BACKGROUND OF THE INVENTION

1. Field of the Invention

The invention relates to a cell for the molten salt electrolytic production of aluminum which includes a steel shell lined with graphite blocks, a heat retarding insulating layer between the shell and the lining and cathodic current conductors inserted into the lining.

2. Description of the Prior Art

Cells for producing aluminum by electrolysis of aluminum oxide which is dissolved in a fluoride melt, consist of a trough-shaped cathode part which receives the melted electrolyte and the cathodically deposited fused aluminum. Metallic materials are resistant only to a limited degree against the electrolyte and the electrolysis products at an electrolyte temperature of 940° to 980° C. and must therefore be protected against the attack of the electrolyte and electrolysis products. The cathodic part of the electrolysis cell customarily consists of a trough or a shell of steel referred to as a shell which is lined with a material which is resistant to temperature and corrosion under conditions of fusion-electrolysis of aluminum. The lining also connects the actual cathode which consists of fused aluminum, to the cathodic current conductors or bus bars, which means that the material must also be a good electric conductor. Therefore, carbon and graphite blocks are used almost exclusively for lining the shell. The blocks are connected to each other by carbon-containing tamping and cementing compounds and form a layer which is impervious to the fused metal and electrolyte.

The operability of the lining is determined essentially by its chemical and thermal stability and its electric resistance. In the operation of the electrolysis cell, joule heat is developed in the lining which in part is necessary for adjusting the electrolysis temperature. Because of the temperature difference between the electrolyte and the shell, major power losses through heat conduction can be avoided only if the thermal resistance of the lining is very high. To reduce the losses, a heat insulating layer of ceramic insulating material is customarily arranged between the lining of carbon or graphite blocks and the shell. Although the lining and the heat insulating layer are a functional unit, it has heretofore not been recognized that the lining and the heat-retarding insulating layer form a unit advantageous for the electrolysis operation if the material properties and the geometric design are matched to each other. Replacing carbon blocks by graphite blocks without simultaneous change of the heat insulation has no major effect for this reason, although graphite has a comparatively lower electric resistance and is more resistant to electrolytes than carbon. Thus, it is known, for instance, from U.S. Pat. No. 3,369,986 to line the shell alternatively with carbon blocks and graphite blocks without change of the heat insulation, although the electric resistance of the linings relate to each other approximately 4:1 and the measured voltage drop in the linings approximately 2.5:1. According to German Pat. No. 21 05 247 (British equivalent GB-PS 1 362 933), the variance of the cathodic current density is improved by a lining which contains carbon blocks and graphite blocks both. Instead of the graphite blocks, carbon-bonded graphite blocks are also used (semi-graphite, hard-graphite), without the geometry and type of heat insulation being matched to the changed material properties. It is also known that blocks which consists substantially of petroleum coke and are heated to a high temperature, preferably at least 2000° C. are especially resistant to the electrolyte (German Published Non-Prosecuted Application DE-OS 21 12 287 U.S. equivalent U.S. Pat. No. 4,046,650). The properties of these blocks are approximately: Bulk density $-1.57$ g/cm$^3$, porosity $-27\%$, electric resistivity $-14$ $\mu\Omega$m. Nothing has become known regarding the nature of the heat retarding layer.

The heat retarding layer consists customarily of refractory blocks or powders of a thickness of between 50 and 250 mm (U.S. Pat. No. 3,434,957) and it is also known that the heat retarding layer constitutes several individual layers (U.S. Pat. No. 3,723,286). Finally, it is known to change the temperature gradients between the bottom and the lateral part of the lining by special insulating elements between these parts (U.S. Pat. No. 4,118,304). These measures are not matched to the material quality of the lining and their effects are accordingly limited.

SUMMARY OF THE INVENTION

An object of the invention to extend the service life of electrolysis cells for the production of aluminum by matching the heat retarding layer and a lining of graphite blocks, and to reduce the power requirements.

With the foregoing and other objects in view, there is provided in accordance with the invention a cell for the fusion-electrolytic production of aluminum which comprises (a) a steel shell, (b) graphite blocks lining the steel shell, said graphite blocks having a heat conductivity of 80 to 120 W/m·K, an electric resistivity from 6 to 13 $\mu\Omega$m and an accessible pore volume of at most 22%, (c) an insulating layer between the steel shell and the lining of graphite blocks, the insulating layer containing at least two component layers with one component layer having a heat conductivity of 0.1 to 0.2 W/m·K and the other component layer having a heat conductivity of 0.8 to 1.2 W/m·K, (d) the lining of graphite blocks and the insulating lining having a ratio thickness of 1.5 to 3.0, and (e) cathodic current conductors set into the lining.

Other features which are considered as characteristic for the invention are set forth in the appended claims.

Although the invention is illustrated and described herein as embodied in a lining for an electrolysis cell for the production of aluminum, it is nevertheless not intended to be limited to the details shown, since various modifications may be made therein without departing from the spirit of the invention and within the scope and range of equivalents of the claims.

BRIEF DESCRIPTION OF THE DRAWINGS

The invention, however, together with additional objects and advantages thereof will be best understood from the following description when read in connection with the accompanying drawings, in which.

DETAILED DESCRIPTION OF THE INVENTION

Figure 1:
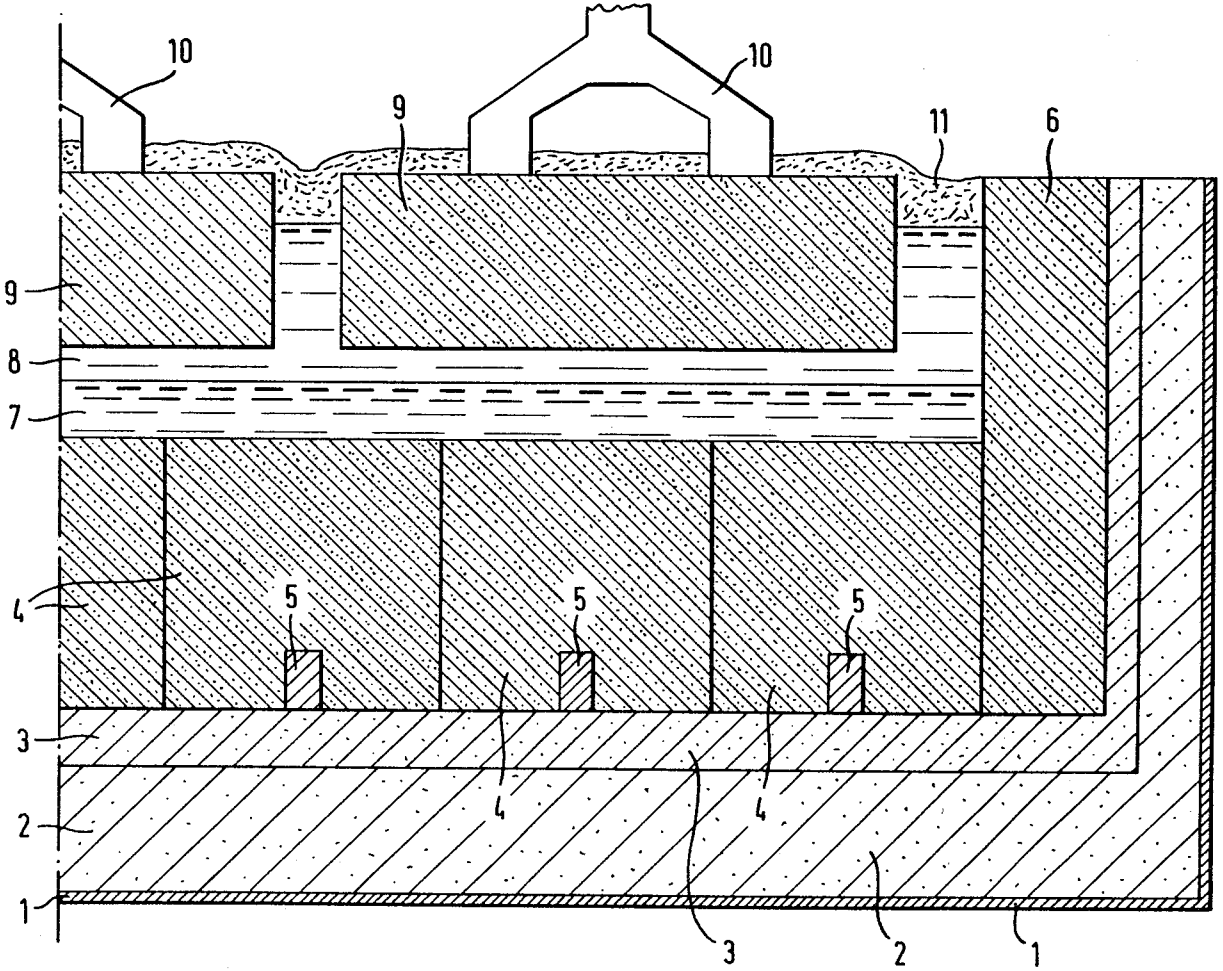
FIG. 1 shows a longitudinal section through an electrolysis cell for producing aluminum.

In accordance with the invention a cell of the type mentioned at the outset, (a) is lined with graphite blocks which have a heat conductivity of 80 to 120 W/m·K, an electric resistivity of 6 to 13 μΩm and an accessible pore volume of at most 22%.

(b) contains a heat retarding insulation layer consisting of at least two partial layers with a heat conductivity of 0.1 to 0.2 and 0.8 to 1.2 W/m·k, and (c) has a thickness ratio of the lining of graphite blocks to the insulating layer of 1.5 to 3.0.

According to a preferred embodiment of the invention, the accessible porosity of the graphite blocks is at most 18% and according to another embodiment, the heat conductivity is 100 to 120 W/m·K and the electric resistivity is 6 to 10 μΩm. Graphite blocks which have been impregnated with a carbonizable impregnating medium and have been heated to approximately 700° to 1000° C. for the pyrolysis of the impregnating medium are particularly well suited for use as the lining. Examples of preferred impregnating mediums are coal tar pitches and petroleum pitches. The heat retarding insulating layer consists advantageously of fire clay, the compression strength of which is more than 10 MPa.

The term "graphite" is understood to mean carbon bodies which have been subjected to a graphitizing treatment and were heated in the process to a temperature above about 2500° C. The result of this treatment depends to a large extent on the starting materials, for example, type of coke used, and the production parameters, for instance the forming method. Although the products are called graphite, only a small part can meet the requirements for use in a cell for the fusion electrolysis manufacture of aluminum. The part of the graphite group usable for this purpose can be selected, i.e. distinguished by means of its material properties.

In the manufacturing of the graphite blocks, petroleum coke, anthracite and other materials consisting substantially of carbon are mixed together with a carbonizable binder, the mixture is formed into blocks and the blocks are heated to approximately 1000° C. in a first stage for carbonizing the binder, and in a second stage to 2600° to 3000° C. Graphite blocks are obtained with relatively high heat conductivity and a low electric resistivity by using raw material with preoriented structure elements and use of higher graphitization temperatures. According to the invention, the heat conductivity of the blocks is 80 to 120 W/m·K and the electric resistivity is 6 to 13 μΩm. The comparatively low resistance brings about a substantial lowering of the voltage drop in the lining, and a lowering of the joule heat generated. Larger temperature differences in the lining which might adversely affect the service life of the cell is eliminated or minimized due to the high heat conductivity of the graphite blocks. Also, in connection with the thermal insulating layer, a greater power outflow from the fused electrolyte is avoided. The effect is particularly advantageous with linings which contain graphite blocks with a heat conductivity of 100 to 120 W/m·K and an electric resistivity of 6 to 10 μΩm. It was found that the open pore volume accessible for the melt, of the graphite blocks must be decreased in order to achieve long service life of the electrolysis cell. The accessible pore volume should at most be 22% and according to a preferred embodiment of the invention, not more than 18%. It is known to impregnate certain carbon and graphite blocks intended for the lining of the electrolysis cells, with furfurol or furfuryl alcohol, and to carbonize, the impregnating agent in situ (U.S. Pat. No. 3,616,045). This method reduces the accessible pore volume, but the size of the accessible pore volume of these blocks is not known. A suitable method for reducing the accessible pore volume of porous graphite, involves impregnating the porous graphite body with coal tar pitch or petroleum pitch and heating the impregnated body to about 700° to 1000° C. to carbonize the pitch. The pores of the graphite body now contain a pitch coke, by means of which the permeability of the graphite body is lowered and its mechanical strength is improved.

The graphite blocks forming the lining of the cell are advantageously cemented together without gaps, where the term "without gaps" is understood to mean gaps with a width of at most 1 mm. The plastic compounds described in European Pat. No. 00 27 534 (U.S. equivalent U.S. Pat. No. 4,288,353) are suitable. The customary gaps with a width of 20 mm and more are weak points of the lining which are easily destroyed by thermal stresses or the fused-in melt.

The invention will be explained in the following with the aid of examples and the drawings.

In FIG. 1, the steel shell is designated with 1. The heat insulating layer consists of the partial layers 2 and 3, the heat conductivities of which partial layers are 0.1 to 0.2 W/m·K and 0.8 to 1.2 W/m·K. The ratio of the heat transfer resistances of the layers is about 0.05. Bus bars or rails 5 are inserted into the graphite blocks 4 resting on the layer 3. The heat conductivity of the graphite blocks is 80 to 120 W/m·K, the electric resistivity is 6 to 13 μΩm and the accessible pore volume is at most 22%. The thickness ratio of the graphite layer 4 to the sum of the layers 2 and 3 is 1.4 to 1.6. The graphite blocks 4 line completely the shell bottom. The lateral surfaces of the shell are shielded by blocks 6 which consist of graphite or carbon. The actual cathode is the aluminum layer 7. The anodes 9 from which the anodic current conductors 10 extend dip into the molten electrolyte 8 and are protected against the attack of atmospheric oxygen by the crust 11 which consists predominantly of aluminum oxide.

The voltage drop measured when a cell for the production of aluminum is put into operation, is essentially a function of the lining. The voltage drop of a lining of carbon blocks is approximately 400 mV, that of a lining with carbon-bonded graphite blocks about 300 mV and that of a lining of graphite blocks according to the invention only about 200 mV. The temperature of the shell with these linings and a heat insulating layer formed of two partial layers A and B with the heat conductivity 1.0 and 0.1 W/m·K is approximately 150° to 50° C. (table I).

TABLE I

| Lining | Insulating Layer | Shell Temperature | Voltage Drop (mV)- |
|---|---|---|---|
| Carbon | A 260 mm | 100–150 | 400 |
| Carbon-bonded graphite | A 170 mm<br>B 90 mm | 40–64 | 300 |
| Graphite | A 170 mm<br>B 90 mm | 45–65 | 200 |
| Graphite | A 90 mm<br>B 170 mm | 35–50 | 200 |

The small energy losses of the lining according to the invention may only be realized if the measured parameters at the start of operation of the electrolysis cell are not changed or changed only little during the later operation of the cell.

Figure 2:
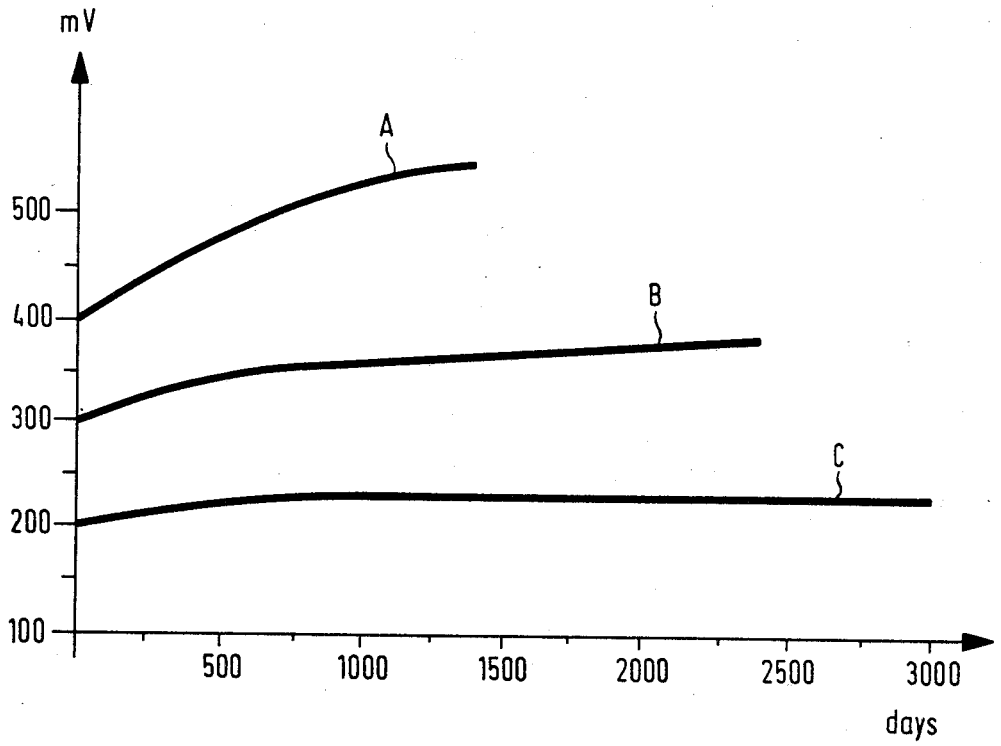
FIG. 2, the voltage drop of various linings as a function of the operating time.

In FIG. 2, the increase of the voltage drop is shown as a function of the operating time; A is a lining consisting of carbon blocks, B a lining of carbon-bonded graphite, and C one of graphite blocks according to the invention. Substantially all the increase of the voltage drop with the operating time is caused by the increasing disintegration and destruction of the lining. The original advantage of linings according to the invention is not only preserved during the operation of the electrolysis cell but is increased relatively with continued operation.

The foregoing is a description corresponding, in substance, to German application P 33 27 230.1, dated July 28, 1983, international priority of which is being claimed for the instant application, and which is hereby made part of this application. Any material discrepancies between the foregoing specification and the specification of the aforementioned corresponding German application are to be resolved in favor of the latter.

There is claimed:

1. Cell for the fusion-electrolytic production of aluminum which comprises (a) a steel shell, (b) graphite blocks lining the steel shell, said graphite blocks having a heat conductivity of 80 to 120 W/m·K, an electric resistivity from 6 to 13 $\mu\Omega$m and an accessible pore volume of at most 22%, (c) an insulating layer between the steel shell and the lining of graphite blocks, said insulating layer containing at least two component layers with one component layer having a heat conductivity of 0.1 to 0.2 W/m·K and the other component layer having a heat conductivity of 0.8 to 1.2 W/m·K, (d) said lining of graphite blocks and said insulating lining having a ratio thickness of 1.5 to 3.0, and (e) cathodic current conductors set into the graphite blocks lining.

2. Cell according to claim 1, wherein the graphite blocks have an accessible porosity of at most 18%.

3. Cell according to claim 2, wherein the graphite blocks have a heat conductivity of 100 to 120 W/m·K and an electric resistivity of 6 to 10 $\mu\Omega$m.

4. Cell according to claim 3, wherein that the insulating layer consists of fire clay with a compression strength of at least 10 MPa.

5. Cell according to claim 2, wherein the graphite blocks contain coke formed by carbonization of an impregnating medium selected from the group consisting of coal tar pitch and petroleum pitch.

6. Cell according to claim 2, wherein that the insulating layer consists of fire clay with a compression strength of at least 10 MPa.

7. Cell according to claim 1, wherein the graphite blocks have a heat conductivity of 100 to 120 W/m·K and an electric resistivity of 6 to 10 $\mu\Omega$m.

8. Cell according to claim 7, wherein the graphite blocks contain coke formed by carbonization of an impregnating medium selected from the group consisting of coal tar pitch and petroleum pitch.

9. Cell according to claim 7, wherein that the insulating layer consists of fire clay with a compression strength of at least 10 MPa.

10. Cell according to claim 1, wherein the graphite blocks contain coke formed by carbonization of an impregnating medium selected from the group consisting of coal tar pitch and petroleum pitch.

11. Cell according to claim 1, wherein that the insulating layer consists of fire clay with a compression strength of at least 10 MPa.

* * * * *